US009709955B2

(12) United States Patent
Hirayama

(10) Patent No.: US 9,709,955 B2
(45) Date of Patent: Jul. 18, 2017

(54) SWITCH DEVICE AND TIMEPIECE

(71) Applicant: CASIO COMPUTER CO., LTD., Shibuya-ku, Tokyo (JP)

(72) Inventor: Sen Hirayama, Urayasu (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/083,202

(22) Filed: Mar. 28, 2016

(65) Prior Publication Data

US 2016/0357152 A1 Dec. 8, 2016

(30) Foreign Application Priority Data

Jun. 2, 2015 (JP) ..... 2015-112535

(51) Int. Cl.
*G04B 27/00* (2006.01)

(52) U.S. Cl.
CPC ..... *G04B 27/00* (2013.01)

(58) Field of Classification Search
CPC ..... G04B 27/00; G04B 37/103
USPC ..... 200/302.2, 302.1, 341, 345; 368/190, 368/288–290, 319–321, 206, 216
See application file for complete search history.

(56) References Cited

U.S. PATENT DOCUMENTS 5,383,166 A * 1/1995 Gallay ..... G04B 37/103 368/288
7,111,977 B2 9/2006 Hiranuma et al.
7,347,620 B2 * 3/2008 Omori ..... G04B 3/043 368/288
8,371,745 B2 * 2/2013 Manni ..... G04C 3/004 368/306
8,608,372 B2 * 12/2013 Koshoji ..... G04C 3/001 368/308
8,911,143 B2 * 12/2014 Kitahara ..... G04B 3/04 368/308

FOREIGN PATENT DOCUMENTS

JP 2004271361 A 9/2004

* cited by examiner

*Primary Examiner* — Edwin A. Leon
(74) *Attorney, Agent, or Firm* — Holtz, Holtz & Volek PC

(57) ABSTRACT

A switch device includes a case having a through hole, an operation member which is inserted into the through hole of the case and protrudes inside and outside the case, a waterproof member which is placed on at least one of the outer surface and the inner surface of the case and into which the operation member is slidably inserted, and a press member which presses the waterproof member against the case.

20 Claims, 7 Drawing Sheets

SWITCH DEVICE AND TIMEPIECE

CROSS-REFERENCE TO RELATED APPLICATION

This application is based upon and claims the benefit of priority from the prior Japanese Patent Application No. 2015-112535, filed Jun. 2, 2015, the entire contents of which are incorporated herein by reference.

BACKGROUND OF THE INVENTION

1. Field of the Invention

The present invention relates to a switch device that is used in various types of electronic devices including a timepiece such as a wristwatch, a cellular phone, and a portable information terminal, and a timepiece including the switch device.

2. Description of the Related Art

For example, a switch device for a wristwatch is known in which a tubular member is mounted in a through hole of a wristwatch case, an operation member is slidably provided in the tubular member with it protruding inside and outside the wristwatch case, and a waterproof ring is provided on the outer circumferential surface of the operation member, so that waterproof protection is achieved by the waterproof ring being slid while being in pressure contact with the inner circumferential surface of the tubular member, as disclosed in Japanese Patent Application Laid-Open (Kokai) Publication No. 2004-271361.

In this type of switch device, a ring attaching groove is provided in the outer circumferential surface of the operation member, and the waterproof ring is fitted in the ring attaching groove. In this state, the operation member is slidably inserted into the tubular member of the wristwatch case so that the outer circumferential portion of the waterproof ring comes in pressure contact with the inner circumferential surface of the tubular member, and the inner circumferential surface of the waterproof ring is pressed toward the inside of the ring attaching groove with the reactive force of the resultant contact pressure force, whereby waterproof protection is achieved.

However, in this switch device, when the waterproof ring in pressure contact with the inner circumferential surface of the tubular member slides along with the sliding operation of the operation member, the outer circumferential surface of the waterproof ring is worn by the friction of the waterproof ring with the inner circumferential surface of the tubular member. This wearing leads to a reduction in the pressure contact force of the waterproof ring, which results in a reduction in the waterproofness. Accordingly, it is difficult to ensure the reliability of the waterproofness over a long period of time.

SUMMARY OF THE INVENTION

The present invention is to provide a switch device which ensures waterproofness over a long period of time and a timepiece including the switch device.

In accordance with one aspect of the present invention, there is provided a switch device comprising: a case having a through hole; an operation member which is inserted into the through hole of the case and protrudes inside and outside the case; a waterproof member which is placed on at least one of an outer surface and an inner surface of the case and into which the operation member is slidably inserted; and a press member which presses the waterproof member against the case.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

First Embodiment

A first embodiment in which the present invention has been applied to a wristwatch will hereinafter be described with reference to FIG. 1 to FIG. 3.

Figure 1:
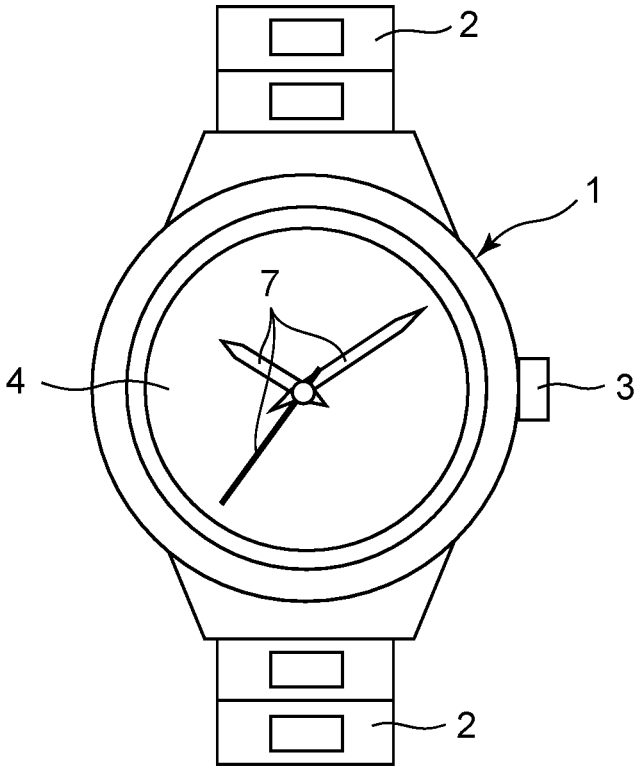
FIG. 1 is a front view of the first embodiment in which the present invention has been applied to a wristwatch.
Figure 2:
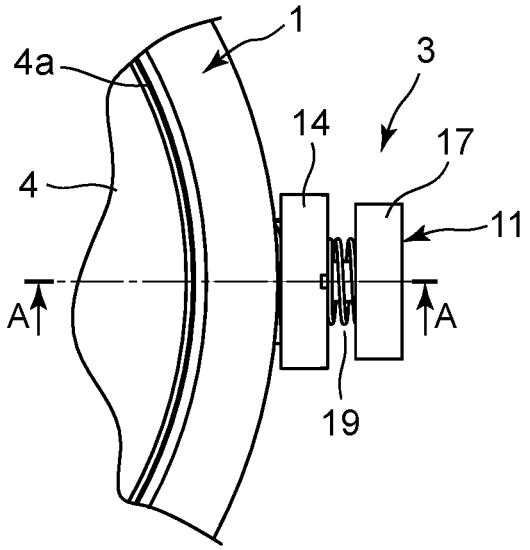
FIG. 2 is an enlarged front view of the main portion of the wristwatch shown in FIG. 1.
Figure 3:
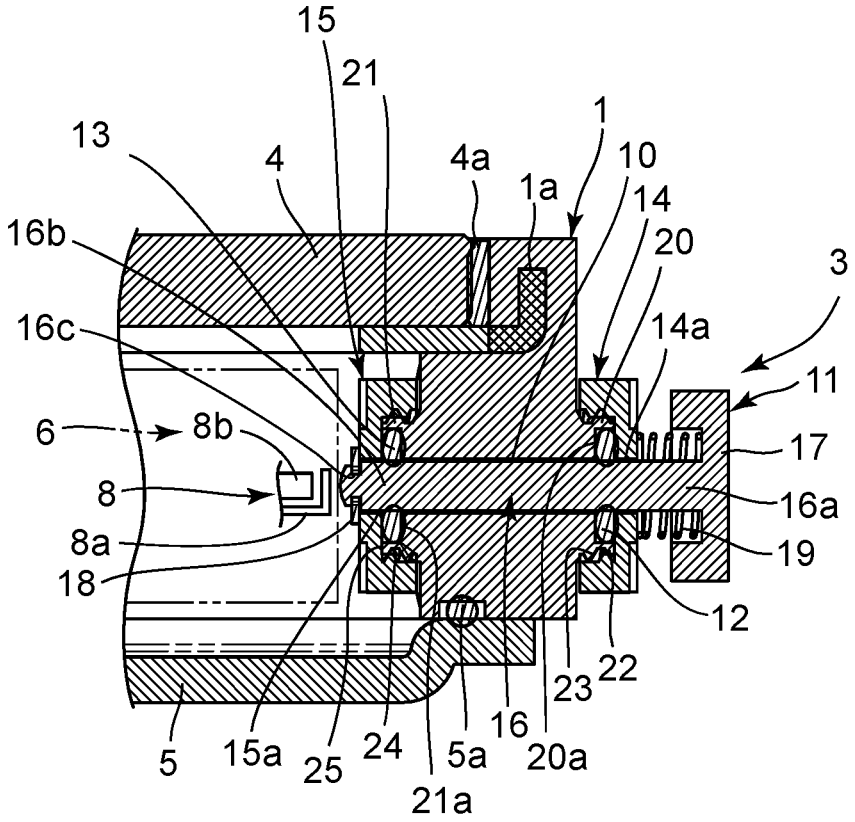
FIG. 3 is an enlarged sectional view of the main portion of the wristwatch taken along line A-A in FIG. 2.

As shown in FIGS. 1 to 3, this wristwatch includes a wristwatch case 1, and a timepiece band 2 is attached to the 12 o'clock side and 6 o'clock side of the wristwatch case 1. On the 3 o'clock side of the wristwatch case 1, a switch device 3 is provided.

The wristwatch case 1 is formed from a hard synthetic resin, and a reinforcing member 1*a* made of a metal is embedded in the case, as shown in FIG. 3. Also, a timepiece glass 4 is attached to the upper opening portion of this wristwatch case 1 via a packing 4*a*, and a hack cover 5 is attached to the lower portion of the wristwatch case 1 via a packing 5*a*.

In addition, a timepiece module 6 is provided in the wristwatch case 1, as shown in FIG. 3. This timepiece module 6 includes various types of components necessary for timepiece functions, such as a timepiece movement (not shown) which drives hands 7 to indicate the time and a switch contact 8, as shown in FIG. 1 and FIG. 3.

The switch device 3 includes an operation member 11 slidably attached in a through hole 10 of the wristwatch case 1, first and second waterproof members 12 and 13 arranged on the outer and inner surfaces of the wristwatch case 1 corresponding to the through hole 10, and first and second press members 14 and 15 which respectively press the first and second waterproof members 12 and 13 against the wristwatch case 1, as shown in FIG. 3.

The operation member 11 includes a shaft section 16 which is slidably inserted into the through hole 10 of the wristwatch case 1 and protrudes inside and outside the wristwatch case 1, a head section 17 which is provided on an outer end portion 16*a* of the shaft section 16 and protrudes outside the wristwatch case 1, a retaining member 18 such as an E-ring which is attached to an inner end portion 16*b* of the shaft section 16 and comes in contact with the inner surface of the wristwatch case 1 such that it is separable, and a coil spring 19 which forces the head section 17 in a direction to press it toward the outside of the wristwatch case 1, as shown in FIG. 3.

In this embodiment, the shaft section 16 is formed to have an outer diameter equal to or slightly smaller than the inner diameter of the through hole 10 of the wristwatch case 1 and have an axial length longer than that of the through hole 10, as shown in FIG. 3. The head section 17 is formed to have an almost cap-like cylindrical shape having an outer diameter larger than that of the shaft section 16. For example, the head section 17 has an outer diameter about three times larger than that of the shaft section 16. Also, the head section 17 has an inner diameter larger than the outer diameter of the shaft section 16. For example, the head section 17 has an inner diameter about two times larger than the outer diameter of the shaft section 16.

The retaining member 18 is attached in an annular attaching groove 16*c* provided in the outer circumference of the inner end portion 16*b* of the shaft section 16 protruding inside the wristwatch case 1, and comes in contact with the later-described second press member 15 on the inner surface of the wristwatch case 1 such that it is separable, as shown in FIG. 3. As a result of this structure, by the retaining member 18 coming in contact with the second press member 15 located in the wristwatch case 1, the shaft section 16 is prevented from slipping out of the wristwatch case 1.

The coil spring 19 is placed on the outer circumference of the shaft section 16, as shown in FIG. 3. One end portion of the coil spring 19 comes in resilient contact with the inner surface of the head section 17, and the other end portion comes in resilient contact with the later-described first press member 14 placed on the outer surface of the wristwatch case 1. As a result, the coil spring 19 is structured to press, with its spring force, both the head section 17 and the shaft section 16 toward the outside of the wristwatch case 1.

As a result, the operation member 11 is structured such that, when the head section 17 is pressed against the spring force of the coil spring 19, the shaft section 16 slides inside the through hole 10 so that the inner end portion 16*b* of the shaft section 16 protrudes inside the wristwatch case 1, and the protruding inner end portion 16*b* presses the switch contact 8 of the timepiece module 6, whereby a switching operation is performed, as shown in FIG. 3.

That is, the switch contact 8 includes a flat spring section 8*a* and a contact section 8*b*, as shown in FIG. 3. The flat spring section 8*a* is structured to perform a switching operation by elastically deforming and coming in separable contact with the contact section 8*b* when it is pushed by the inner end portion 16*b* of the shaft section 16.

In this embodiment, a first cylindrical projecting section 20 on which the first waterproof member 12 is mounted is provided on the outer surface of the wristwatch case 1 so as to correspond to the through hole 10 of the wristwatch case 1, and projects toward the outside, as shown in FIG. 3. This first cylindrical projecting section 20 is formed to have an outer diameter equal to or slightly larger than the inner diameter of the head section 17.

As shown in FIG. 3, a mounting groove 20*a* in which the first waterproof member 12 is mounted is provided in an inner circumferential portion located on the outer end side of the first cylindrical projecting section 20. That is, the mounting groove 20*a* is an annular notched concave portion, which is provided with it being opened to the outside of the wristwatch case 1 and the inside of the through hole 10.

Also, as shown in FIG. 3, a second cylindrical projecting section 21 on which the second waterproof member 13 is mounted is provided on the inner surface of the wristwatch case 1 so as to correspond to the through hole 10 of the wristwatch case 1, and projects toward inside the wristwatch case 1. This second cylindrical projecting section 21 is formed to have an outer diameter equal to that of the first cylindrical projecting section 20.

Moreover, as shown in FIG. 3, a mounting groove 21*a* in which the second waterproof member 13 is mounted is provided in an inner circumferential portion located on the inner end side of the second cylindrical projecting section 21. That is, as with the mounting groove 20*a* of the first cylindrical projecting section 20, the mounting groove 21*a* is an annular notched concave portion, which is provided with it being opened to the inside of the wristwatch case 1 and the inside of the through hole 10.

The first waterproof member 12 is formed from an elastic synthetic resin to have a ring-like shape, and mounted in the mounting groove 20*a* of the first cylindrical projecting section 20, as shown in FIG. 3. That is, the first waterproof member 12 is formed to have an inner diameter equal to or slightly smaller than the outer diameter of the shaft section 16 of the operation member 11. As a result, the first waterproof member 12 is structured such that its inner circumferential portion protrudes inside the through hole 10 and come in pressure contact with the outer circumferential surface of the shaft section 16. In this state, the shaft section 16 is slid.

Also, the first waterproof member 12 is formed such that the outer diameter portion comes into pressure contact with the inner circumferential surface of the mounting groove 20*a* of the first cylindrical projecting section 20, as shown in FIG. 3. The axial thickness of the first waterproof member 12 is slightly larger than the axial length of the mounting groove 20*a* of the first cylindrical projecting section 20, as shown in FIG. 3. As a result of structure, when the first waterproof member 12 is mounted in the mounting groove 20*a* of the first cylindrical projecting section 20, its outer portion located in the axial direction slightly protrudes from the mounting groove 20*a* toward the outside of the wristwatch case 1.

The first press member 14 is structured to be attached to the first cylindrical projecting section 20 of the wristwatch case 1 so as to cover the first cylindrical projecting section 20 and press the first waterproof member 12 toward the inside of the mounting groove 20*a* of the first cylindrical projecting section 20 in this state, as shown in FIG. 3. That is, the first press member 14 is formed to have an almost cap-like cylindrical shape, and the center of its side surface portion is provided with an insertion hole 14*a* into which the shaft section 16 is inserted.

In addition, the first press member 14 is formed to have an outer diameter equal to or slightly larger than that of the head section 17 and have an inner diameter equal to the outer diameter of the first cylindrical projecting section 20, as shown in FIG. 3. Moreover, the first press member 14 is formed such that the axial length (depth) inside it is equal to or slightly shorter than the axial length of the first cylindrical projecting section 20.

Furthermore, the first press member 14 is structured such that a female screw section 22 is provided on the inner circumferential surface and threadably engaged with a male screw section 23 provided on the outer circumference of the first cylindrical projecting section 20, as shown in FIG. 3. As a result, the first press member 14 is structured to be attached to the outer circumference of the first cylindrical projecting section 20 so as to cover it.

In this structure, when the first press member 14 is attached to the first cylindrical projecting section 20 with the first waterproof member 12 being mounted in the mounting groove 20*a* of the first cylindrical projecting section 20, the first press member 14 presses the first waterproof member 12 toward the inside of the mounting groove 20*a* of the first cylindrical projecting section 20 in accordance with the fastening force of the first press member 14, i.e., the fastening force of the female screw section 22 with respect to the male screw section 23, as shown in FIG. 3.

In this embodiment, the first waterproof member 12 is structured such that, when it is compressed in the axial direction of the through hole 10 by a pressing force generated by the fastening of the first press member 14, the outer circumferential portion of the first waterproof member 12 comes in pressure contact with the inner circumferential surface of the mounting groove 20*a*, and the inner circumferential portion comes in pressure contact with the outer circumferential surface of the shaft section 16, as shown in FIG. 3. By this structure, the first waterproof member 12 ensures both waterproofness between the shaft section 16 and the through hole 10 and airtightness in the wristwatch case 1.

On the other hand, as with the first waterproof member 12, the second waterproof member 13 is formed to have a ring-like shape from an elastic synthetic resin, and mounted in the mounting groove 21*a* of the second cylindrical projecting section 21, as shown in FIG. 3. That is, the second waterproof member 13 is formed to have an inner diameter equal to or slightly smaller than the outer diameter of the shaft section 16 of the operation member 11. As a result of this structure, the inner circumferential portion of the second waterproof member 13 also protrudes inside the through hole 10 and comes in pressure contact with the outer circumferential surface of the shaft section 16. In this state, the shaft section 16 is slid.

Also, as with the first waterproof member 12, the second waterproof member 13 is formed such that the outer diameter comes in pressure contact with the inner circumferential surface of the mounting groove 21*a* of the second cylindrical projecting section 21, and the axial thickness of the second waterproof member 13 is slightly larger than the axial length of the mounting groove 21*a* of the second cylindrical projecting section 21, as shown in FIG. 3. As a result of this structure, when the second waterproof member 13 is mounted in the mounting groove 21*a* of the second cylindrical projecting section 21, its inside portion located in the axial direction slightly protrudes from the mounting groove 21*a* toward the inside of the wristwatch case 1.

As in the case of the first press member 14, the second press member 15 is structured to be attached to the second cylindrical projecting section 21 of the wristwatch case 1 so as to cover the second cylindrical projecting section 21 and press the second waterproof member 13 toward the inside of the mounting groove 21*a* of the second cylindrical projecting section 21 in this state, as shown in FIG. 3. That is, the second press member 15 is also formed to have an almost cap-like cylindrical shape, and the center of its side surface portion is provided with an insertion hole 15*a* into which the shaft section 16 is inserted.

Also, as with the first press member 14, the second press member 15 is formed to have an outer diameter equal to or slightly larger than that of the head section 17 and have an inner diameter equal to the outer diameter of the second cylindrical projecting section 21, as shown in FIG. 3. Moreover, the second press member 15 is formed such that the axial length (depth) inside it is equal to or slightly shorter than the axial length of the second cylindrical projecting section 21.

Furthermore, as with the first press member 14, the second press member 15 is structured such that a female screw section 24 is provided on the inner circumferential surface, and threadably engaged with a male screw section 25 provided on the outer circumference of the second cylindrical projecting section 21, as shown in FIG. 3. As a result of this structure, the second press member 15 is attached to the outer circumference of the second cylindrical projecting section 21 so as to cover it.

In this structure, as with the first press member 14, when the second press member 15 is attached to the second cylindrical projecting section 21 with the second waterproof member 13 being mounted in the mounting groove 21*a* of the second cylindrical projecting section 21, the second press member 15 presses the second waterproof member 13 toward the inside of the mounting groove 21*a* of the second cylindrical projecting section 21 in accordance with the fastening force of the second press member 15, i.e., the fastening force of the female screw section 22 with respect to the male screw section 23, as shown in FIG. 3.

In this case as well, the second waterproof member 13 is structured such that, when it is compressed in the axial direction of the through hole 10 with a pressing force generated by the fastening of the second press member 15, the outer circumferential portion of the second waterproof member 13 comes in pressure contact with the inner circumferential surface of the mounting groove 21*a*, and the inner circumferential portion comes in pressure contact with the outer circumferential surface of the shaft section 16, as shown in FIG. 3. By this structure, the second waterproof member 13 also ensures both waterproofness between the shaft section 16 and the through hole 10 and airtightness in the wristwatch case 1.

Next, the operation of the switch device 3 of the wristwatch is described.

In the mounting of the switch device 3 to the wristwatch case 1, first, the first and second waterproof members 12 and 13 are attached to the outside and inside portions of the wristwatch case 1 by the first and second press members 14 and 15.

That is, the first waterproof member 12 is mounted in the mounting groove 20*a* of the first cylindrical projecting section 20 projecting outside the wristwatch case 1. In this state, the first press member 14 is attached to the first cylindrical projecting section 20. Here, the female screw section 22 of the first press member 14 is threadably engaged with and lightly fastened to the male screw section 23 of the first cylindrical projecting section 20. This lightly presses the first waterproof member 12 against the mounting groove 20*a* of the first cylindrical projecting section 20.

Similarly, the second waterproof member 13 is mounted in the mounting groove 21*a* of the second cylindrical projecting section 21 projecting inside the wristwatch case 1. In this state, the second press member 15 is attached to the second cylindrical projecting section 21. In this case as well, the female screw section 24 of the second press member 15 is threadably engaged with and lightly fastened to the male screw section 25 of the second cylindrical projecting section 21. This lightly presses the second waterproof member 13 against the mounting groove 21*a* of the second cylindrical projecting section 21.

In this state, the timepiece glass 4 is attached to the upper opening portion of the wristwatch case 1, and the operation member 11 is attached to the through hole 10 of the wristwatch case 1 by being inserted thereinto. Here, first, the coil spring 19 is mounted on the outer circumference of the shaft section 16 of the operation member 11. In this state, the inner end portion 16*b* of the shaft section 16 is inserted into the first waterproof member 12 and the through hole 10 from the insertion hole 14*a* of the first press member 14 located on the outside of the wristwatch case 1. In addition, the inserted inner end portion 16*b* of the shaft section 16 is inserted into the second waterproof member 13 and the insertion hole 15*a* of the second press member 15 from the through hole 10 so as to protrude inside the wristwatch case 1.

Subsequently, the head section 17 of the operation member 11 is pressed against the spring force of the coil spring 19 so that the inner end portion 16*b* of the shaft section 16 further protrudes inside the wristwatch case 1. In this state, the retaining member 18 is attached in the attaching groove 16*c* provided in the inner end portion 16*b* of the shaft section 16. As a result, the operation member 11 is attached in the through hole 10 of the wristwatch case 1. In this state, the head section 17 of the operation member 11 is pressed toward the outside of the wristwatch case 1 by the spring force of the coil spring 19, and the retaining member 18 comes in contact with the second press member 15 in the wristwatch case 1.

In this state, the pressing forces of the first and second press members 14 and 15 are adjusted with respect to the first and second waterproof members 12 and 13. That is, the fastening force of the female screw section 22 of the first press member 14 with respect to the male screw section 23 of the first cylindrical projecting section 20 is adjusted by rotating the first press member 14. This compresses the first waterproof member 12 in the axial direction of the through hole 10, whereby the inner circumferential portion of the first waterproof member 12 comes in pressure contact with the outer circumference of the shaft section 16 of the operation member 11 in an optimal state, and the outer circumferential portion of the first waterproof member 12 comes in pressure contact with the inner circumferential surface of the mounting groove 20*a* of the first cylindrical projecting section 20 in an optimal state.

Similarly, the fastening force of the female screw section 24 of the second press member 15 with respect to the male screw section 25 of the second cylindrical projecting section 21 is adjusted by the rotation of the second press member 15. This compresses the second waterproof member 13 in the axial direction of the through hole 10, whereby the inner circumferential portion of the second waterproof member 13 comes in pressure contact with the outer circumference of the shaft section 16 of the operation member 11 in an optimal state, and the outer circumferential portion of the second waterproof member 13 comes in pressure contact with the inner circumferential surface of the mounting groove 21*a* of the second cylindrical projecting section 21 in an optimal state.

Then, the timepiece module 6 is placed in the wristwatch case 1 such that the flat spring section 8*a* of the switch contact 8 of the timepiece module 6 corresponds to the inner end portion 16*b* of the shaft section 16, and the back cover 5 is attached to the lower portion of the wristwatch case 1. As a result the switch device 3 is mounted in the wristwatch case 1.

Next, the operation of the switch device 3 is described.

In this embodiment, first, the head section 17 of the operation member 11 is pressed against the spring force of the coil spring 19. As a result, the shaft section 16 of the operation member 11 slides inside the through hole 10 of the wristwatch case 1, and the inner end portion 16*b* of the shaft section 16 protrudes inside the wristwatch case 1.

By this operation, the inner end portion 16*b* of the shaft section 16 protruding inside the wristwatch case 1 presses the switch contact 8 of the timepiece module 6 to perform a switching operation. That is, the inner end portion 16*b* of the shaft section 16 presses the flat spring section 8*a* of the switch contact 8, whereby the flat spring section 8*a* elastically deforms and comes in contact with the contact section 8*b*. As a result, the switch contact 8 enters an ON state.

In addition, when an external force is removed from the head section 17 of the operation member 11, the head section 17 is pressed toward the outside of the wristwatch case 1 by the spring force of the coil spring 19. As a result, the shaft section 16 of the operation member 11 slides inside the through hole 10 of the wristwatch case 1, and the inner end portion 16*b* of the shaft section 16 separates from the switch contact 8. Accordingly, the flat spring section 8*a* elastically returns to the original shape and separates from the contact section 8*b*, whereby the switch contact 8 enters an OFF state.

When the shaft section 16 is sliding in the through hole 10, the first and second waterproof members 12 and 13 are in pressure contact with the inside portions of the mounting grooves 20*a* and 21*a* of the first and second cylindrical projecting sections 20 and 21 by the pressing forces of the first and second press members 14 and 15 in optimal states and are also in slidable pressure contact with the outer circumferential surface of the shaft section 16 of the operation member 11 in optimal states.

For this reason, when sliding in the through hole 10, the shaft section 16 slides with it being in pressure contact with the inside portions of the first and second waterproof members 12 and 13. Therefore, even when the shaft section 16 slides inside the through hole 10, the first and second waterproof members 12 and 13 can ensure both waterproofness between the shaft section 16 and the through hole 10 and airtightness in the wristwatch case 1.

In addition, since the first and second waterproof members 12 and 13 are located at the outer end portion and inner end portion of the through hole 10 of they wristwatch case 1, the first and second waterproof members 12 and 13 are located at the maximum distance, and therefore the shaft section 16 of the operation member 11 is slidably held in a stable state by the first and second waterproof members 12 and 13 located at the maximum distance.

For this reason, when sliding in the through hole 10, the shaft section 16 stably slides in parallel with the central axis of the through hole 10 without tilting in the axial direction. Here, the first and second waterproof members 12 and 13 slide with them being equally in pressure contact with the outer circumferential surface of the shaft section 16. By this structure as well, the first and second waterproof members 12 and 13 can ensure both waterproofness between the shaft section 16 and the through hole 10 and airtightness in the wristwatch case 1.

As described above, the switch device 3 of this wristwatch includes the operation member 11 which is inserted into the through hole 10 of the wristwatch case 1 while protruding inside and outside the case, the first and second waterproof members 12 and 13 which are respectively arranged on the outer surface and the inner surface of the wristwatch case 1 and into which the first and second waterproof members 12 and 13 are slidably inserted, and the first and second press members 14 and 15 which press the first and second waterproof members 12 and 13 against the wristwatch case 1. By this structure, waterproofness can be ensured over a long period of time.

That is, in the switch device 3 of this wristwatch, the first and second press members 14 and 15 press the first and second waterproof members 12 and 13 against the wristwatch case 1 and bring them into pressure contact with the operation member 11. By this structure, even when the first and second waterproof members 12 and 13 are worn along with the sliding operation of the operation member 11, reductions in the contact pressure forces of the first and second waterproof members 12 and 13 by the wearing can be suppressed. This makes it possible to prevent a reduction in waterproofness provided by the first and second waterproof members 12 and 13, whereby waterproofness is ensured over a long period of time.

In this embodiment, the first cylindrical projecting section 20 on which the first waterproof member 12 is mounted is provided on the outer surface of the wristwatch case 1 in a manner to correspond to the through hole 10 of the wristwatch case 1, and the first press member 14 is attached to the first cylindrical projecting section 20 so as to cover it. Accordingly, the first waterproof member 12 can be reliably pressed against the first cylindrical projecting section 20 by the first press member 14. As a result of this structure, the first waterproof member 12 can reliably and favorably come in pressure contact with the shaft section 16 of the operation member 11, whereby waterproofness and airtightness in the wristwatch case 1 can be ensured.

That is, the female screw section 22 provided on the inner circumferential surface of the first press member 14 is threadably engaged with the male screw section 23 provided on the outer circumference of the first cylindrical projecting section 20, and the pressing force of the first waterproof member 12 with respect to the wristwatch case 1 is adjusted by the fastening force acting on the threaded portions. This can bring the first waterproof member 12 into pressure contact with the inside portion of the mounting groove 20*a* of the first cylindrical projecting section 20 in an optimal state, and can bring the first waterproof member 12 into slidable pressure contact with the outer circumference of the shaft section 16 of the operation member 11 in an optimal state, whereby both waterproofness and airtightness in the wristwatch case 1 can be ensured.

In addition, the second cylindrical projecting section 21 on which the second waterproof member 13 is mounted is provided on the inner surface of the wristwatch case 1 in a manner to correspond to the through hole 10 of the wristwatch case 1, and the second press member 15 is attached to the second cylindrical projecting section 21 so as to cover it. Accordingly, the second waterproof member 13 can be reliably pressed against the second cylindrical projecting section 21. This can reliably and favorably bring the second waterproof member 13 into pressure contact with the shaft section 16 of the operation member 11, whereby both waterproofness and airtightness in the wristwatch case 1 can be ensured.

That is, the female screw section 24 provided on the inner circumferential surface of the second press member 15 is threadably engaged with the male screw section 25 provided on the outer circumference of the second cylindrical projecting section 21, and the pressing force of the second waterproof member 13 with respect to the wristwatch case 1 is adjusted by the fastening force acting on the threaded portions. This can bring the second waterproof member 13 into pressure contact with the inside portion of the mounting groove 21*a* of the second cylindrical projecting section 21 in an optimal state, and can bring the second waterproof member 13 into slidable pressure contact with the outer circumference of the shaft section 16 of the operation member 11 in an optimal state, whereby both waterproofness and airtightness in the wristwatch case 1 can be ensured.

In addition, the switch device 3 has the first waterproof member 12 and the first press member 14 provided on the outer surface of the wristwatch case 1, and also has the second waterproof member 13 and the second press member 15 provided on the inner surface of the wristwatch case 1. By this structure, the first and second waterproof members 12 and 13 can be placed at the maximum distance. As a result, the shaft section 16 of the operation member 11 can be slidably held by the first and second waterproof members 12 and 13 located at the maximum distance, whereby the operation member 11 can be favorably held in a stable state.

By this structure, in the switch device 3, the shaft section 16 can slide parallel to the central axis of the through hole 10 without tilting with respect to the axial direction when the operation member 11 is pressed and operated to slide inside the through hole 10 of the shaft section 16. As a result, the first and second waterproof members 12 and 13 can slide with them being equally in pressure contact with the outer circumferential surface of the shaft section 16, and therefore can ensure both waterproofness between the shaft section 16 and the through hole 10 and airtightness in the wristwatch case 1.

Second Embodiment

Next, the second embodiment in which the present invention has been applied to a wristwatch is described with reference to FIG. 4 and FIG. 5. Note that sections identical to those of the first embodiment shown in FIG. 1 to FIG. 3 are provided with the same reference numerals.

Figure 4:
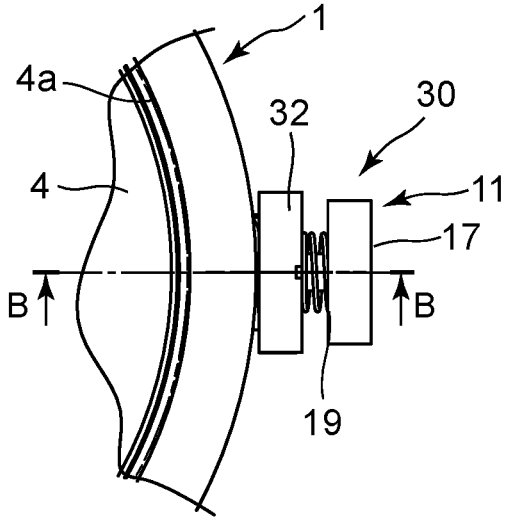
FIG. 4 is an enlarged front view of the main portion of the second embodiment in which the present invention has been applied to a wristwatch.
Figure 5:
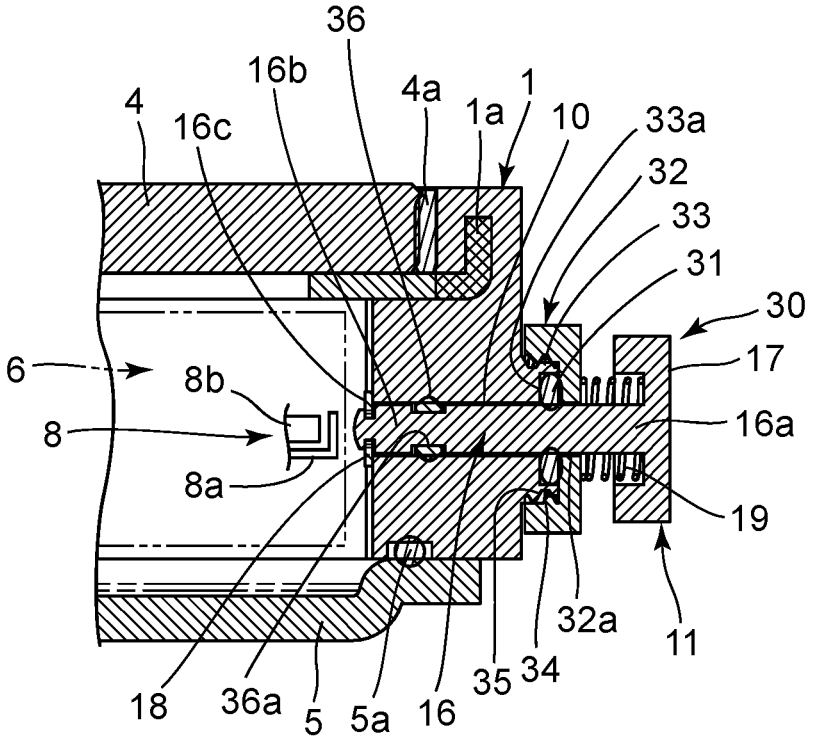
FIG. 5 is an enlarged sectional view of the main portion of the wristwatch taken along line B-B in FIG. 4.

As shown in FIGS. 4 and 5, a switch device 30 of this wristwatch has the same structure as that of the first embodiment except that an outer waterproof member 31 and a press member 32 are provided on the outer surface of the wristwatch case 1 and an inner waterproof member 36 is separately provided in a through hole 10 located in the inside portion of the wristwatch case 1.

In this embodiment, as with the first cylindrical projecting section 20 in the first embodiment, a cylindrical projecting section 33 on which the outer waterproof member 31 is mounted projects toward the outside of the wristwatch case 1 with it corresponding to the through hole 10 of the wristwatch case 1, as shown in FIG. 5. This cylindrical projecting section 33 is formed to have an outer diameter equal to or slightly larger than the inner diameter of a head section 17.

In addition, a mounting groove 33*a* in which the outer waterproof member 31 is mounted is provided in the inner circumferential portion on the outer end side of the cylindrical projecting section 33, as shown in FIG. 5. As in the case of the mounting groove 20*a* of the first cylindrical projecting section 20 in the first embodiment, the mounting groove 33*a* is an annular notched concave portion, which is provided with it being opened to the outside of the wristwatch case 1 and the inside of the through hole 10.

Also, as in the case of the first waterproof member 12 in the first embodiment, the outer waterproof member 31 is formed to have a ring-like shape from an elastic synthetic resin, and mounted in the mounting groove 33*a* of the cylindrical projecting section 33, as shown in FIG. 5. That is, the outer waterproof member 31 is formed to have an inner diameter equal to or slightly smaller than the outer diameter of the shaft section 16 of the operation member 11. By this structure, the inner circumferential portion of the outer waterproof member 31 protrudes inside the through hole 10 and comes in pressure contact with the outer circumferential surface of the shaft section 16, and the shaft section 16 slides in this state.

In addition, the outer waterproof member 31 is formed such that its outer diameter portion comes in pressure contact with the inner circumferential surface of the mounting groove 33*a* of the cylindrical projecting section 33, and the axial thickness of the outer waterproof member 31 is slightly larger than the axial length of the mounting groove 32*a* of the cylindrical projecting section 33, as shown in FIG. 5. As a result, when the outer waterproof member 31 is mounted in the mounting groove 33*a* of the cylindrical projecting section 33, the outside portion located in the axial direction slightly protrudes from the mounting groove 33*a* toward the outside of the wristwatch case 1.

As in the case of the first press member 14 in the first embodiment, the press member 32 is attached to the cylindrical projecting section 33 of the wristwatch case 1 so as to cover the cylindrical projecting section 33, and presses the outer waterproof member 31 toward the inside of the mounting groove 33*a* of the cylindrical projecting section 33 in this state, as shown in FIG. 5. That is, the press member 32 is formed to have an almost cap-like cylindrical shape, and the center of its side surface portion is provided with an insertion hole 32*a* into which the shaft section 16 is inserted.

This press member 32 is formed to have an outer diameter equal to or slightly larger than that of the head section 17 and an inner diameter equal to the outer diameter of the cylindrical projecting section 33, as shown in FIG. 5. In addition, this press member 32 is formed such that the axial length (depth) inside it is equal to or slightly shorter than the axial length of the cylindrical projecting section 33.

Also, as with the first press member 14 in the first embodiment, the press member 32 is structured such that a female screw section 34 is provided on the inner circumferential surface and threadably engaged with a male screw section 35 provided on the outer circumference of the cylindrical projecting section 33, as shown in FIG. 5. As a result, the first press member 32 is structured to be attached to the outer circumference of the cylindrical projecting section 33 so as to cover it.

In this structure, when the press member 32 is attached to the cylindrical projecting section 33 with the outer waterproof member 31 being mounted in the mounting groove 33*a* of the cylindrical projecting section 33, the press member 32 presses the outer waterproof member 31 toward the inside of the amounting groove 33*a* of the cylindrical projecting section 33 in accordance with the fastening force of the press member 32, i.e., the fastening force of the female screw section 34 with respect to the male screw section 35, as shown in FIG. 5.

In this embodiment, the outer waterproof member 31 is structured such that, when it is compressed in the axial direction of the through hole 10 by a pressing force generated by the fastening of the press member 32, the outer circumferential portion of the outer waterproof member 31 comes in pressure contact with the inner circumferential surface of the mounting groove 33*a*, and the inner circumferential portion comes in pressure contact with the outer circumferential surface of the shaft section 16, as shown in FIG. 5. By this structure, the outer waterproof member 31 ensures both waterproofness between the shaft section 16 and the through hole 10 and airtightness in the wristwatch case 1.

As shown in FIG. 5, the inner waterproof member 36 is separately provided between the through hole 10 and the shaft section 16 of the operation member 11 located inside the wristwatch case 1. As in the case of the outer waterproof member 31 located on the outer surface of the wristwatch case 1, the inner waterproof member 36 located inside the wristwatch case 1 is formed to have a ring-like shape from an elastic synthetic resin.

The inner waterproof member 36 is structured to be attached to a portion of the outer circumferential surface of the shaft section 16 on the inner end portion 16*b* side of the shaft section 16, i.e., a portion away from the outer waterproof member 31 on the outer surface side of the wristwatch case 1 toward the inside of the wristwatch case 1, as shown in FIG. 5. That is, the inner waterproof member 36 is structured such that it is mounted in an annular groove 36*a* provided at a portion located on the inner end portion 16*b* side of the shaft section 16, and the outer circumferential portion of the inner waterproof member 36 slides in this state with it being in pressure contact with the inner circumferential surface of the through hole 10.

In this embodiment, the operation member 11 is structured such that, when the head section 17 is pressed together with the shaft section 16 toward the outside of the wristwatch case 1 with the spring force of the coil spring 19, the retaining member 18 attached to the inner end portion 16*b* of the shaft section 16 comes in separable contact with the inner surface of the wristwatch case 1, and thereby prevents the shaft section 16 from slipping out of the wristwatch case 1 together with the head section 17, as shown in FIG. 5.

Next, the operation of the switch device 30 in the wristwatch case 1 is described.

As with the first embodiment, when the head section 17 of the operation member 11 is pressed against the spring force of the coil spring 19, the shaft section 16 of the operation member 11 slides inside the through hole 10 of the wristwatch case 1, and the inner end portion 16*b* of the shaft section 16 protrudes inside the wristwatch case 1.

By this operation, the inner end portion 16*b* of the shaft section 16 protruding inside the wristwatch case 1 presses the switch contact 8 of the timepiece module 6 to perform a switching operation. Here, the inner end portion 16*b* of the shaft section 16 presses the flat spring section 8*a* of the switch contact 8 so that the flat spring section 8*a* elastically deforms and comes in contact with the contact section 8*b*, as with the first embodiment. As a result, the switch contact 8 enters the ON state.

In addition, when an external force is removed from the head section 17 of the operation member 11, the head section 17 is pressed toward the outside of the wristwatch case 1 by the spring force of the coil spring 19, as with the first embodiment. Accordingly, the shaft section 16 of the operation member 11 slides inside the through hole 10 of the wristwatch case 1, and the inner end portion 16*b* of the shaft section 16 separates from the switch contact 8. As a result, the flat spring section 8*a* elastically returns to the original shape and separates from the contact section 8*b*, whereby the switch contact 8 enters the OFF state.

When the shaft section 16 is sliding in the through hole 10, the outer waterproof member 31 is in pressure contact with the inside portion of the mounting groove 33*a* of the cylindrical projecting section 33 by the pressing force of the press member 32 in an optimal state and is also in slidable pressure contact with the outer circumferential surface of the shaft section 16 of the operation member 11 in an optimal state. For this reason, since the shaft section 16 slides with it being in pressure contact with the inside portion of the outer waterproof member 31, the outer waterproof member 31 can ensure both waterproofness between the shaft section 16 and the through hole 10 and airtightness in the wristwatch case 1 even when the shaft section 16 slides inside the through hole 10.

Also, here, another inner waterproof member 36 located inside the wristwatch case 1 is mounted in the annular groove 36*a* provided in the outer circumferential surface of a portion of the shaft section 16 located on the inner end portion 16*b* side, and the outer circumferential portion of the inner waterproof member 36 slides in this state with it being in pressure contact with the inner circumferential surface of the through hole 10. Therefore, even when the shaft section 16 slides inside the through hole 10, the inner waterproof member 36 can ensure both waterproofness between the shaft section 16 and the through hole 10 and airtightness in the wristwatch case 1.

In this embodiment, since the outer waterproof member 31 is located on the outer end portion of the through hole 10 of the wristwatch case 1 and the inner waterproof member 36 is located on the inner end portion of the through hole 10 of the wristwatch case 1, the outer waterproof member 31 and the inner waterproof member 36 are located at a large distance. That is, the shaft section 16 of the operation member 11 is slidably held in a stable state by the outer waterproof member 31 and the inner waterproof member 36 which are located at such a large distance.

For this reason, when sliding in the through hole 10, the shaft section 16 stably slides in parallel with the central axis of the through hole 10 without tilting with respect to the axial direction. Here, the outer waterproof member 31 and the inner waterproof member 36 slide with them being equally in pressure contact with the outer circumferential surface of the shaft section 16. By this structure as well, the outer waterproof member 31 and the inner waterproof member 36 can ensure both waterproofness between the shaft section 16 and through hole 10 and airtightness in the wristwatch case 1.

As described above, the switch device 30 of this wristwatch includes the operation member 11 inserted into the through hole 10 of the wristwatch case 1 so as to protrude inside and outside the case, the outer waterproof member 31 which is placed on the outer surface of the wristwatch case 1 and into which the operation member 11 is slidably inserted, and the press member 32 which presses the outer waterproof member 31 against the wristwatch case 1. As a result, this switch device 30 can ensure waterproofness over a long period of time, as in the first embodiment.

That is, in the switch device 30 of this wristwatch, the press member 32 can press the outer waterproof member 31 against the wristwatch case 1 and bring the outer waterproof member into pressure contact with the operation member 11. Therefore, even if the outer waterproof member 31 wears by the sliding operation of the operation member 11, a reduction in the pressing force of the outer waterproof member 31 due to the wear can be suppressed, whereby a reduction in waterproofness caused by the outer waterproof member 31 can be prevented and therefore waterproofness can be ensured over a long period of time.

In this embodiment, the cylindrical projecting section 33 on which the outer waterproof member 31 is mounted is provided on the outer surface of the wristwatch case 1 in a manner to correspond to the through hole 10 of the wristwatch case 1, and the press member 32 is attached to the cylindrical projecting section 33 so as to cover it. Accordingly, the press member 32 can reliably press the outer waterproof member 31 against the cylindrical projecting section 33, whereby the outer waterproof member 31 can reliably and favorably come in pressure contact with the shaft section 16 of the operation member 11 and both waterproofness and airtightness in the wristwatch case 1 can be ensured.

That is, the female screw section 34 provided on the inner circumferential surface of the press member 32 is threadably engaged with the male screw section 35 provided on the outer circumference of the cylindrical projecting section 33 and, by this fastening force, the pressing force of the outer waterproof member 31 is adjusted with respect to the wristwatch case 1. This can bring the outer waterproof member 31 into pressure contact with the inside portion of the mounting groove 33*a* of the cylindrical projecting section 33 in an optimal state, and can bring the outer waterproof member 31 into slidable pressure contact with the outer circumference of the shaft section 16 of the operation member 11 in an optimal state, whereby both waterproofness and airtightness in the wristwatch case 1 can be ensured.

Also, in the switch device 30, the inner waterproof member 36 is separately provided between the inner surface of the through hole 10 and the outer circumferential surface of the shaft section 16 of the operation member 11 on the inner surface side of the wristwatch case 1. Accordingly, by this inner waterproof member 36 as well, both waterproofness and airtightness in the wristwatch case 1 can be ensured. In addition, by the outer waterproof member 31 and the inner waterproof member 36, the shaft section 16 of the operation member 11 can be favorably held in a slidable state.

In this embodiment since the outer waterproof member 31 is located on the outer end portion of the through hole 10 of the wristwatch case 1 and the inner waterproof member 36 is located on the inner end portion of the through hole 10 of the wristwatch case 1, the outer waterproof member 31 and the inner waterproof member 36 are located at a large distance. Accordingly, the shaft section 16 of the operation member 11 can be slidably held by the outer waterproof member 31 and the inner waterproof member 36 located at a large distance, by which the operation member 11 can be favorably held in a stable state.

Thus, in this switch device 30 as well, when sliding inside the through hole 10 by the operation member 11 being pressed, the shaft section 16 stably slides in parallel with the central axis of the through hole 10 without tilting with respect to the axial direction, so that the outer waterproof member 31 and the inner waterproof member 36 slide with them being equally in pressure contact with the outer circumferential surface of the shaft section 16. Accordingly, by the outer waterproof member 31 and the inner waterproof member 36, both waterproofness between the shaft section 16 and through hole 10 and airtightness in the wristwatch case 1 can be ensured.

Third Embodiment

Next, the third embodiment in which the present invention has been applied to a wristwatch is described with reference to FIG. 6 and FIG. 7. Note that, in this embodiment as well, sections identical to those of the first embodiment shown in FIG. 1 to FIG. 3 are provided with the same reference numerals.

Figure 6:
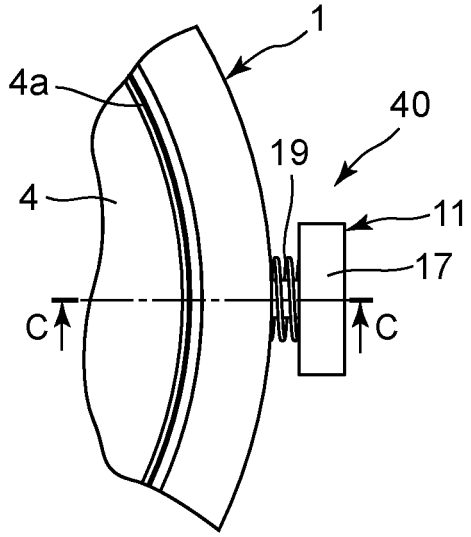
FIG. 6 is an enlarged front view of the main portion of the third embodiment in which the present invention has been applied to a wristwatch.
Figure 7:
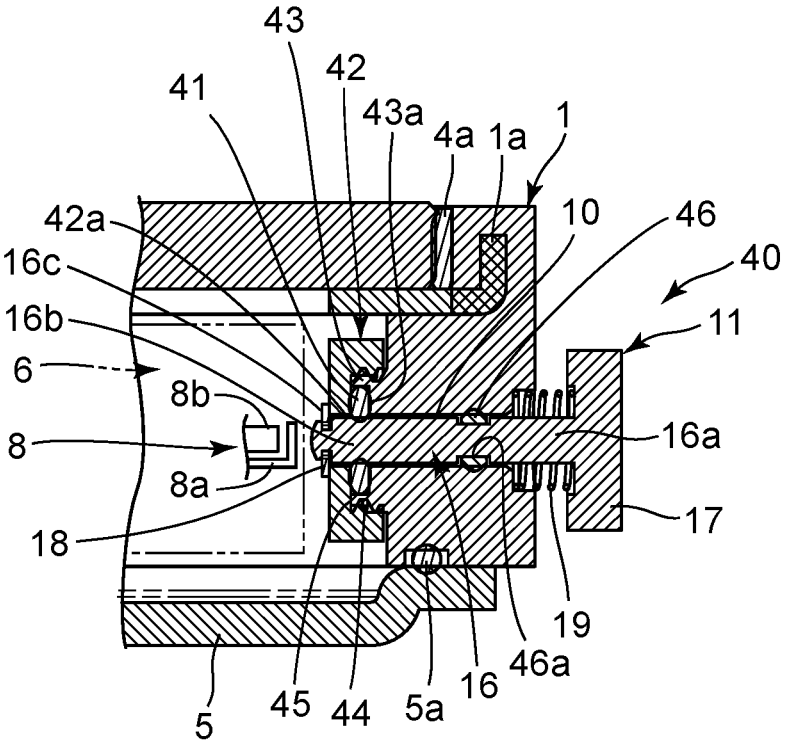
FIG. 7 is an enlarged sectional view of the main portion of the wristwatch taken along line C-C in FIG. 6.

A switch device 40 of this wristwatch has the same structure as that of the first embodiment except that an inner waterproof member 41 and a press member 42 are provided on the inner surface of the wristwatch case 1 and an outer waterproof member 46 is separately provided in the through hole 10 on the outside of the wristwatch case 1, as shown in FIGS. 6 and 7.

In this embodiment, as with the second cylindrical projecting section 21 in the first embodiment, a cylindrical projecting section 43 on which the inner waterproof member 41 is mounted protrudes from the inner surface of the wristwatch case 1 toward the inside of the wristwatch case 1 in a manner to correspond to the through hole 10 of the wristwatch case 1, as shown in FIG. 7. This cylindrical projecting section 43 is formed to have an outer diameter equal to or slightly larger than the inner diameter of a head section 17.

Also, as shown in FIG. 7, a mounting groove 43*a* in which the inner waterproof member 41 is mounted is provided in the inner circumferential portion on the inner end side of the cylindrical projecting section 43. As in the case of the mounting groove 21*a* of the second cylindrical projecting section 21 in the first embodiment, the mounting groove 43*a* is an annular notched concave portion, which is provided with it being opened to the inside of the wristwatch case 1 and the inside of the through hole 10.

As in the case of the second waterproof member 13 in the first embodiment, the inner waterproof member 41 is formed to have a ring-like shape from an elastic synthetic resin, and mounted in the mounting groove 43*a* of the cylindrical projecting section 43, as shown in FIG. 7. That is, the inner waterproof member 41 is formed to have an inner diameter equal to or slightly smaller than the outer diameter of a shaft section 16 of an operation member 11. By this structure, the inner circumferential portion of the inner waterproof member 41 protrudes inside the through hole 10 and comes in pressure contact with the outer circumferential surface of the shaft section 16, and the shaft section 16 slides in this state.

In addition, the inner waterproof member 41 is formed such that its outer diameter portion comes in pressure contact with the inner circumferential surface of the mounting groove 43*a* of the cylindrical projecting section 43, and the axial thickness of the inner waterproof member 41 is slightly larger than the axial length of the mounting groove 43*a* of the cylindrical projecting section 43, as shown in FIG. 7. As a result, when the inner waterproof member 41 is mounted in the mounting groove 43*a* of the cylindrical projecting section 43, the inside portion located in the axial direction slightly protrudes from the mounting groove 43*a* toward the inside of the wristwatch case 1.

As in the case of the second press member 15 in the first embodiment, the press member 42 is attached to the cylindrical projecting section 43 of the wristwatch case 1 so as to cover the cylindrical projecting section 43, and presses the inner waterproof member 41 toward the inside of the mounting groove 43*a* of the cylindrical projecting section 43 in this state, as shown in FIG. 7. That is, the press member 42 is formed to have an almost cap-like cylindrical shape, and the center of its side surface portion is provided with an insertion hole 42*a* into which the shaft section 16 is inserted.

This press member 42 is formed to have an outer diameter equal to or slightly larger than that of the head section 17 and an inner diameter equal to the outer diameter of the cylindrical projecting section 43, as shown in FIG. 7. In addition, this press member 42 is formed such that the axial length (depth) inside it is equal to or slightly shorter than the axial length of the cylindrical projecting section 43.

Also, as with the second press member 15 in the first embodiment, the press member 42 is structured such that a female screw section 44 is provided on the inner circumferential surface and threadably engaged with a male screw section 45 provided on the outer circumference of the cylindrical projecting section 43, as shown in FIG. 7. As a result, the first press member 42 is structured to be attached to the outer circumference of the cylindrical projecting section 43 so as to cover it.

In this structure, when the press member 42 is attached to the cylindrical projecting section 43 with the inner waterproof member 41 being mounted in the mounting groove 43*a* of the cylindrical projecting section 43, the press member 42 presses the inner waterproof member 41 toward the inside of the mounting groove 43*a* of the cylindrical projecting section 43 in accordance with the fastening force of the press member 42, i.e., the fastening force of the female screw section 44 with respect to the male screw section 45, as shown in FIG. 7.

In this embodiment, the inner waterproof member 41 is structured such that, when it is compressed in the axial direction of the through hole 10 by a pressing force generated by the fastening of the press member 42, the outer circumferential portion of the inner waterproof member 41 comes in pressure contact with the inner circumferential surface of the mounting groove 43*a*, and the inner circumferential portion comes in pressure contact with the outer circumferential surface of the shaft section 16, as shown in FIG. 7. By this structure, the inner waterproof member 41 ensures both waterproofness between the shaft section 16 and the through hole 10 and airtightness in the wristwatch case 1.

As shown in FIG. 7, the outer waterproof member 46 is separately provided between the through hole 10 and the shaft section 16 of the operation member 11 located on the outside of the wristwatch case 1. As in the case of the inner waterproof member 41 located on the inner surface of the wristwatch case 1, the outer waterproof member 46 located on the outside of the wristwatch case 1 is formed to have a ring-like shape from an elastic synthetic resin.

The outer waterproof member 46 is structured to be attached to a portion of the outer circumferential surface of the shaft section 16 on the outer end portion 16*a* side of the shaft section 16, i.e., a portion away from the inner waterproof member 41 on the inner surface side of the wristwatch case 1 toward the outside of the wristwatch case 1, as shown in FIG. 7. That is, the outer waterproof member 46 is structured such that it is mounted in an annular groove 46*a* provided at a portion located on the outer end portion 16*a* side of the shaft section 16, and the outer circumferential portion of the outer waterproof member 46 slides in this state with it being in pressure contact with the inner circumferential surface of the through hole 10.

Next, the operation of the switch device 40 in the wristwatch case 1 is described.

As with the first embodiment, when the head section 17 of the operation member 11 is pressed against the spring force of the coil spring 19, the shaft section 16 of the operation member 11 slides inside the through hole 10 of the wristwatch case 1, and the inner end portion 16*b* of the shaft section 16 protrudes inside the wristwatch case 1.

By this operation, the inner end portion 16*b* of the shaft section 16 protruding inside the wristwatch case 1 presses the switch contact 8 of the timepiece module 6 to perform a switching operation. Here, the inner end portion 16*b* of the shaft section 16 presses the flat spring section 8*a* of the switch contact 8 so that the flat spring section 8*a* elastically deforms and comes in contact with the contact section 8*b*, as with the first embodiments. As a result, the switch contact 8 enters the ON state.

In addition, when an external force is removed from the head section 17 of the operation member 11, the head section 17 is pressed toward the outside of the wristwatch case 1 by the spring force of the coil spring 19, as with the first embodiment. Accordingly, the shaft section 16 of the operation member 11 slides inside the through hole 10 of the wristwatch case 1, and the inner end portion 16*b* of the shaft section 16 separates from the switch contact 8. As a result, the flat spring section 8*a* elastically returns to the original shape and separates from the contact section 8*b*, whereby the switch contact 8 enters the OFF state.

When the shaft section 16 is sliding in the through hole 10, the inner waterproof member 41 is in pressure contact with the inside portion of the mounting groove 43*a* of the cylindrical projecting section 43 by the pressing force of the press member 42 in an optimal state and is also in slidable pressure contact with the outer circumferential surface of the shaft section 16 of the operation member 11 in an optimal state. For this reason, since the shaft section 16 slides with it being in pressure contact with the inside portion of the inner waterproof member 41, the inner waterproof member 41 can ensure both waterproofness between the shaft section 16 and the through hole 10 and airtightness in the wristwatch case 1 even when the shaft section 16 slides inside the through hole 10.

Also, here, another outer waterproof member 46 located on the outside of the wristwatch case 1 is mounted in the annular groove 46*a* provided in the outer circumferential surface of a portion of the shaft section 16 located on the outer end portion 16*a* side, and the outer circumferential portion of the outer waterproof member 46 slides in this state with it being in pressure contact with the inner circumferential surface of the through hole 10. Therefore, even when the shaft section 16 slides inside the through hole 10, the outer waterproof member 46 can ensure both waterproofness between the shaft section 16 and the through hole 10 and airtightness in the wristwatch case 1.

In this embodiment, since the inner waterproof member 41 is located on the inner end portion of the through hole 10 of the wristwatch case 1 and the outer waterproof member 46 on the outer side is located on the outer end portion of the through hole 10 of the wristwatch case 1, the inner waterproof member 41 and the outer waterproof member 46 are located at a large distance. That is, the shaft section 16 of the operation member 11 is slidably held in a stable state by the inner waterproof member 41 and the outer waterproof member 46 which are located at such a large distance.

For this reason, when sliding in the through hole 10, the shaft section 16 stably slides in parallel with the central axis of the through hole 10 without tilting with respect to the axial direction. Here, the inner waterproof member 41 and the outer waterproof member 46 slide with them being equally in pressure contact with the outer circumferential surface of the shaft section 16. By this structure as well, the inner waterproof member 41 and the outer waterproof member 46 can ensure both waterproofness between the shaft section 16 and through hole 10 and airtightness in the wristwatch case 1.

As described above, the switch device 40 of this wristwatch includes the operation member 11 inserted into the through hole 10 of the wristwatch case 1 so as to protrude inside and outside the case, the inner waterproof member 41 which is placed on the inner surface of the wristwatch case 1 and into which the operation member 11 is slidably inserted, and the press member 42 which presses the inner waterproof member 41 against the wristwatch case 1. As a result, this switch device 40 can ensure waterproofness over a long period of time, as in the first embodiment.

That is, in the switch device 40 of this wristwatch, the press member 42 can press the inner waterproof member 41 against the wristwatch case 1 and bring the inner waterproof member 41 into pressure contact with the operation member 11. Therefore, even if the inner waterproof member 41 wears by the sliding operation of the operation member 11, a reduction in the pressing force of the inner waterproof member 41 due to the wear can be suppressed, whereby a reduction in waterproofness caused by the inner waterproof member 41 can be prevented and therefore waterproofness can be ensured over a long period of time.

In this embodiment, the cylindrical projecting section 43 on which the inner waterproof member 41 is mounted is provided on the inner surface of the wristwatch case 1 in a manner to correspond to the through hole 10 of the wristwatch case 1, and the press member 42 is attached to the cylindrical projecting section 43 so as to cover it. Accordingly, the press member 42 can reliably press the inner waterproof member 41 against the cylindrical projecting section 43, whereby the inner waterproof member 41 can reliably and favorably come in pressure contact with the shaft section 16 of the operation member 11 and both waterproofness and airtightness in the wristwatch case 1 can be ensured.

That is, the female screw section 44 provided on the inner circumferential surface of the press member 42 is threadably engaged with the male screw section 45 provided on the outer circumference of the cylindrical projecting section 43 and, by this fastening force, the pressing force of the inner waterproof member 41 is adjusted with respect to the wristwatch case 1. This can bring the inner waterproof member 41 into pressure contact with the inside portion of the mounting groove 43*a* of the cylindrical, projecting section 43 in an optimal state, and can bring the inner waterproof member 41 into slidable pressure contact with the outer circumference of the shaft section 16 of the operation member 11 in an optimal state, whereby both waterproofness and airtightness in the wristwatch case 1 can be ensured.

Also, in the switch device 40, the outer waterproof member 46 is separately provided between the inner surface of the through hole 10 and the outer circumferential surface of the shaft section 16 of the operation member 11 on the outer surface side of the wristwatch case 1. Accordingly, by this outer waterproof member 46 on the outer side as well, both waterproofness and airtightness in the wristwatch case 1 can be ensured. In addition, by the inner waterproof member 41 and the outer waterproof member 46, the shaft section 16 of the operation member 11 can be favorably held in a slidable state.

In this embodiment since the inner waterproof member 41 is located on the inner end portion of the through hole 10 of the wristwatch case 1 and the outer waterproof member 46 is located on the outer end portion of the through hole 10 of the wristwatch case 1, the inner waterproof member 41 and the cuter waterproof member 46 can be located at a large distance. Accordingly, the shaft section 16 of the operation member 11 can be slidably held by the inner waterproof member 41 and the outer waterproof member 46 located at a large distance, by which the operation member 11 can be favorably held in a stable state.

Thus in this switch device 40 as well, when sliding inside the through hole 10 by the operation member 11 being pressed, the shaft section 16 stably slides in parallel with the central axis of the through hole 10 without tilting with respect to the axial direction, so that the inner waterproof member 41 and the outer waterproof member 46 slide with them being equally in pressure contact with the outer circumferential surface of the shaft section 16. Accordingly, by the inner waterproof member 41 and the outer waterproof member 46, both waterproofness between the shaft section 16 and through hole 10 and airtightness in the wristwatch case 1 can be ensured.

In the first to third embodiments the head section 17 of the operation member 11 is forced toward the outside of the wristwatch case 1 by the spring force of the coil spring 19. However, the coil spring 19 is not necessarily required to be used in the present invention. For example, the shaft section 16 of the operation member 11 may be forced toward the outside of the wristwatch case 1 by the spring force of the flat spring section 8*a* of the switch contact 8.

Also, in the first to third embodiments, the female screw section provided on the inner circumferential surface of the press member is threadably engaged with the male screw section provided on the outer circumference of the cylindrical projecting section. However, the present invention is not limited to the structure where the screw sections are threadably engaged. For example, a structure may be adopted in which the inner circumferential surface of the press member and the outer circumference of the cylindrical projecting section are fitted into and fixed to each other by being brought into pressure contact with each other. By this structure as well, the waterproof member can be reliably pressed and both waterproofness and airtightness in the wristwatch case can be ensured.

Moreover, in the first to third embodiments, the present invention has been applied to a wristwatch. However, the present invention is not limited thereto. For example, the present invention can be applied to various types of timepieces such as a travel watch, an alarm watch, a standing clock, and a wall clock. In addition, the present invention is not necessarily required to be applied to a timepiece and can be widely applied to electronic devices such as a cellular phone and a portable information terminal.

While the present invention has been described with reference to the preferred embodiments, it is intended that the invention be not limited by any of the details of the description therein but includes all the embodiments which fall within the scope of the appended claims.

What is claimed is:

1. A switch device comprising:

a case having a through hole;

an operation member comprising a shaft which is inserted into the through hole of the case and protrudes inside and outside the case;

a plurality of waterproof members, the plurality of waterproof members comprising an inner waterproof member provided at an inner end portion of the case and an outer waterproof member provided at an outer end portion of the case, wherein the plurality of waterproof members include a waterproof member placed on at least one of an outer surface and an inner surface of the case, and wherein the shaft is slidably inserted into the through hole to be slidable with respect to the waterproof members; and at least one press member which presses at least one of the waterproof members against the case.

2. The switch device according to claim 1, further comprising:

at least one cylindrical projecting section provided on at least one of the outer surface and the inner surface of the case in a manner to correspond to the through hole of the case, at least one of the waterproof members being mounted on the at least one cylindrical projection, wherein the at least one press member is attached to the at least one cylindrical projecting section so as to cover the cylindrical projecting section.

3. The switch device according to claim 2, wherein a female screw section provided on an inner circumferential surface of the at least one press member is threadably engaged with a male screw section provided on an outer circumference of the at least one cylindrical projecting section, and a pressing force of the at least one waterproof member with respect to the case is adjusted by a fastening force of the female screw section with respect to the male screw section.

4. The switch device according to claim 1, wherein the outer waterproof member is provided on the outer surface of the case, and the inner waterproof member is provided on the inner surface of the case, and wherein the at least one press member comprises an outer press member provided on the outer surface of the case and an inner press member provided on the inner surface of the case.

5. The switch device according to claim 2, wherein the outer waterproof member is provided on the outer surface of the case, and the inner waterproof member is provided on the inner surface of the case, and wherein the at least one press member comprises an outer press member provided on the outer surface of the case and an inner press member provided on the inner surface of the case.

6. The switch device according to claim 3, wherein the outer waterproof member is provided on the outer surface of the case, and the inner waterproof member is provided on the inner surface of the case, and wherein the at least one press member comprises an outer press member provided on the outer surface of the case and an inner press member provided on the inner surface of the case.

7. The switch device according to claim 1, wherein the outer waterproof member and the press member are provided on the outer surface of the case, and wherein no waterproof member and no press member are provided on the inner surface of the case.

8. The switch device according to claim 2, wherein the outer waterproof member and the press member are provided on the outer surface of the case, and wherein no waterproof member and no press member are provided on the inner surface of the case.

9. The switch device according to claim 3, wherein the outer waterproof member and the press member are provided on the outer surface of the case, and wherein no waterproof member and no press member are provided on the inner surface of the case.

10. The switch device according to claim 7, wherein the inner waterproof member is provided separately from the outer waterproof member, between an inner surface of the through hole and an outer circumferential surface of the shaft.

11. The switch device according to claim 8, wherein the inner waterproof member is provided separately from the outer waterproof member, between an inner surface of the through hole and an outer circumferential surface of the shaft.

12. The switch device according to claim 9 wherein the inner waterproof member is provided separately from the outer waterproof member, between an inner surface of the through hole and an outer circumferential surface of the shaft.

13. The switch device according to claim 1, wherein the inner waterproof member and the press member are provided on the inner surface of the case, and wherein no waterproof member and no press member are provided on the outer surface of the case.

14. The switch device according to claim 2, wherein the inner waterproof member and the press member are provided on the inner surface of the case, and wherein no waterproof member and no press member are provided on the outer surface of the case.

15. The switch device according to claim 3, wherein the inner waterproof member and the press member are provided on the inner surface of the case, and wherein no waterproof member and no press member are provided on the outer surface of the case.

16. The switch device according to claim 13, wherein the outer waterproof member is provided separately from the inner waterproof member, between an inner surface of the through hole and an outer circumferential surface of the shaft.

17. The switch device according to claim 14, wherein the outer waterproof member is provided separately from the inner waterproof member, between an inner surface of the through hole and an outer circumferential surface of the shaft.

18. The switch device according to claim 15, wherein the outer waterproof member is provided separately from the inner waterproof member, between an inner surface of the through hole and an outer circumferential surface of the shaft.

19. A timepiece comprising the switch device according to claim 1.

20. A timepiece comprising the switch device according to claim 2.

* * * * *